US009422768B2

(12) United States Patent
Yoo et al.

(10) Patent No.: US 9,422,768 B2
(45) Date of Patent: Aug. 23, 2016

(54) MULTIFUNCTIONAL LADDER

(71) Applicants: Thomas Yoo, Garden Grove, CA (US); Jong Deok Lim, Seoul (KR)

(72) Inventors: Thomas Yoo, Garden Grove, CA (US); Jong Deok Lim, Seoul (KR)

(73) Assignee: Thomas Yoo, Garden Grove, CA (US)

( * ) Notice: Subject to any disclaimer, the term of this patent is extended or adjusted under 35 U.S.C. 154(b) by 0 days.

(21) Appl. No.: 14/340,150

(22) Filed: Jul. 24, 2014

(65) Prior Publication Data

US 2015/0027810 A1 Jan. 29, 2015

(30) Foreign Application Priority Data

Jul. 26, 2013 (KR) ..... 20-2013-0006274

(51) Int. Cl.

*E06C 1/393* (2006.01)
*E06C 7/50* (2006.01)
*E06C 1/387* (2006.01)

(52) U.S. Cl.

CPC ..... *E06C 1/393* (2013.01); *E06C 1/387* (2013.01); *E06C 7/50* (2013.01)

(58) Field of Classification Search

CPC ..... E06C 1/32; E06C 1/387; E06C 1/39; E06C 1/393; E06C 1/38; E06C 1/383; A47C 12/00

See application file for complete search history.

(56) References Cited

U.S. PATENT DOCUMENTS 826,582 A * 7/1906 Laird ..... 182/124
864,898 A * 9/1907 Koues ..... 182/161
2,592,912 A * 4/1952 Knipper ..... 182/33
4,004,652 A * 1/1977 Laboy-Alvarado ..... 182/118
4,053,028 A * 10/1977 Loix ..... 182/1
4,493,392 A 1/1985 Marques
4,699,246 A * 10/1987 Wang ..... 182/24
5,368,126 A * 11/1994 Woodward et al. ..... 182/152
5,720,362 A * 2/1998 Denkins ..... 182/182.2
5,722,507 A * 3/1998 Kain ..... 182/129
5,746,288 A * 5/1998 O'Neal et al. ..... 182/118
D536,799 S * 2/2007 Freitas ..... D25/66
7,690,316 B2 4/2010 Yoo et al.
8,042,653 B2 10/2011 Grebinoski et al.
8,113,316 B2 * 2/2012 Sward et al. ..... 182/222
8,925,682 B2 * 1/2015 Chitayat et al. ..... 182/33
2011/0056764 A1 * 3/2011 Cross et al. ..... 182/27
2013/0192925 A1 * 8/2013 Chitayat et al. ..... 182/152

FOREIGN PATENT DOCUMENTS

KR 2003836980000 5/2005
KR 2004349600000 1/2007

* cited by examiner

*Primary Examiner* — Katherine Mitchell
*Assistant Examiner* — Shiref Mekhaeil
(74) *Attorney, Agent, or Firm* — IPLA P.A.; James E. Bame

(57) ABSTRACT

A combined stepladder and work platform assembly is provided. The assembly comprises a top frame having two side rails and footplate, a back frame pivotally attached to the back side of the top frame and having two side rails, and a front frame pivotally attached to the front side of the top frame and having two side rails. Link bars are provided so that they maintain steps horizontal together with the side rails of the front frame. Four braces secure the back frame and front frame with the top frame at a certain angle when the assembly is used as a work platform. The front frame, the top frame and the back frame form a triangular shape while the back frame is parallel to the floor when the assembly is used as a stepladder.

3 Claims, 3 Drawing Sheets

MULTIFUNCTIONAL LADDER

CROSS REFERENCE

The application claims priority on Korean Patent Application No. 20-2013-0006274, filed on Jul. 26, 2013, and the disclosure of which is incorporated by reference into this application as if fully set forth herein.

BACKGROUND OF THE INVENTION

Generally, a stepladder or a work platform is used to perform a work at an elevated location above reach.

A stepladder is used for a relatively simple work within a limited work area and work platform, which is made to have extended length in transverse direction and allows moving along the platform during work, is used for relatively complicated work.

However, it is inconvenient and uneconomical to prepare and store the both of stepladder and work platform.

SUMMARY OF THE INVENTION

The present invention contrives to solve the disadvantages as described above.

The object of the invention is to provide a combined stepladder and work platform assembly which is easy to convert between its functions. From the folded position, the assembly can be opened to be the stepladder position or work platform position, according to the purpose of use.

To achieve the above-described object, the present invention provides a work platform assembly that comprises a top frame having two side rails and footplate that is fixed between the side rails, a back frame pivotally attached to back side of the top frame and having two side rails, each of which having an upper end and pivotally attached to the side rail of the top frame at the back end, a front frame pivotally attached to the front side of the top frame and having two side rails, each of which having an upper end and pivotally attached to the side rail of the top frame at the front end, a plurality of steps, each end of which are pivotally attached to the side rails of the front frame and a pair of link bars at the same intervals so that the steps are substantially horizontal, a pair of braces, each of which having an upper end pivotally attached to the side rail of the top frame and a lower end pivotally attached to the side rail of back frame so that it secures the back frame with the top frame at a certain angle and another pair of braces, each of which having an upper end pivotally attached to the side rail of the top frame and a lower end pivotally attached to the side rail of the front frame so that it secures the front frame with the top frame at a certain angle.

The assembly includes an elastic foot attached at the lower end of each of the side rails of the front frame and an L shape elastic foot attached at the lower end of each of the side rails of the back frame and another pair of elastic feet attached at the backside of upper portion of the side rails of the back frame.

The brace above mentioned further includes a shorter arm and a longer arm pivotally connected by a pin to allow pivoting of front frame and back frame.

A support bracket bar is pivotally attached to the inside of side rails of top frame, supporting the overhung end portion of the above-described step so that the steps are substantially horizontal in the step ladder position.

The advantages of the present invention are numerous in that: (1) only easy and simple operations are required to convert the assembly between folded, stepladder, and work platform positions; (2) the assembly is sturdy and stable when it is used in any positions according to the purpose of use; (3) the assembly is convenient to store and carry since the front frame and back frame are folded flat.

BRIEF DESCRIPTION OF THE DRAWINGS

These and other features, aspects and advantages of the present invention will become better understood with reference to the accompanying drawings, wherein.

DETAILED DESCRIPTION OF THE INVENTION

Figure 1:
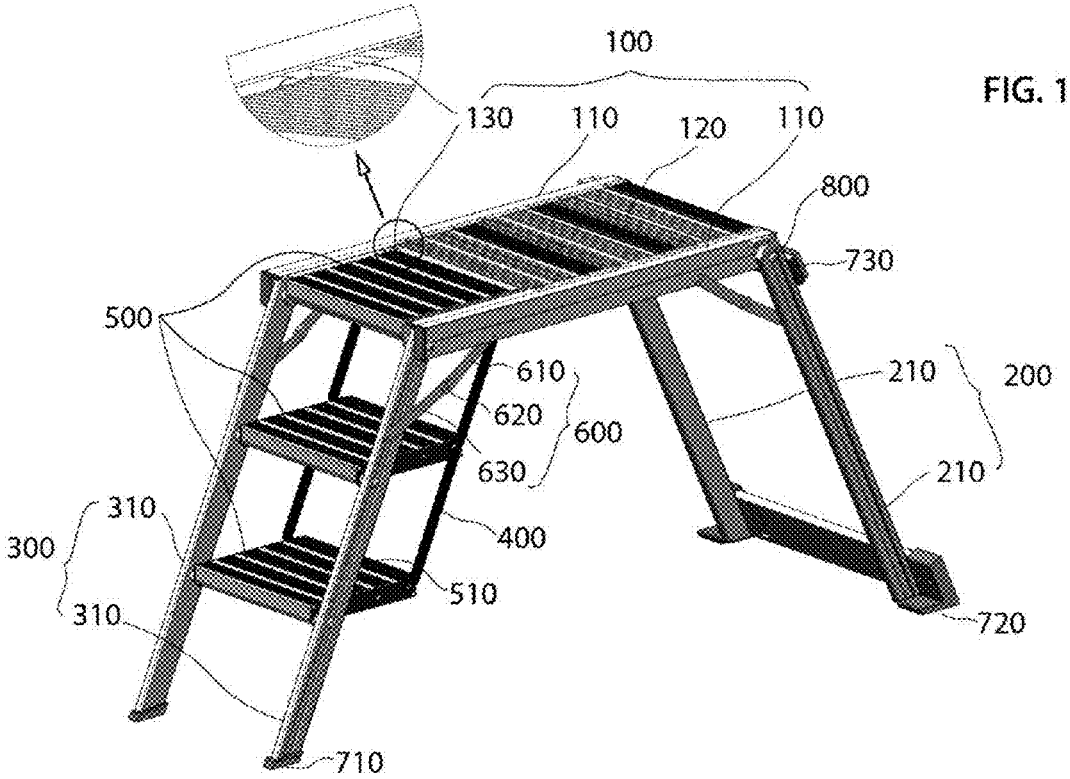
FIG. 1 is a perspective view of the assembly in the work platform position.
Figure 2:
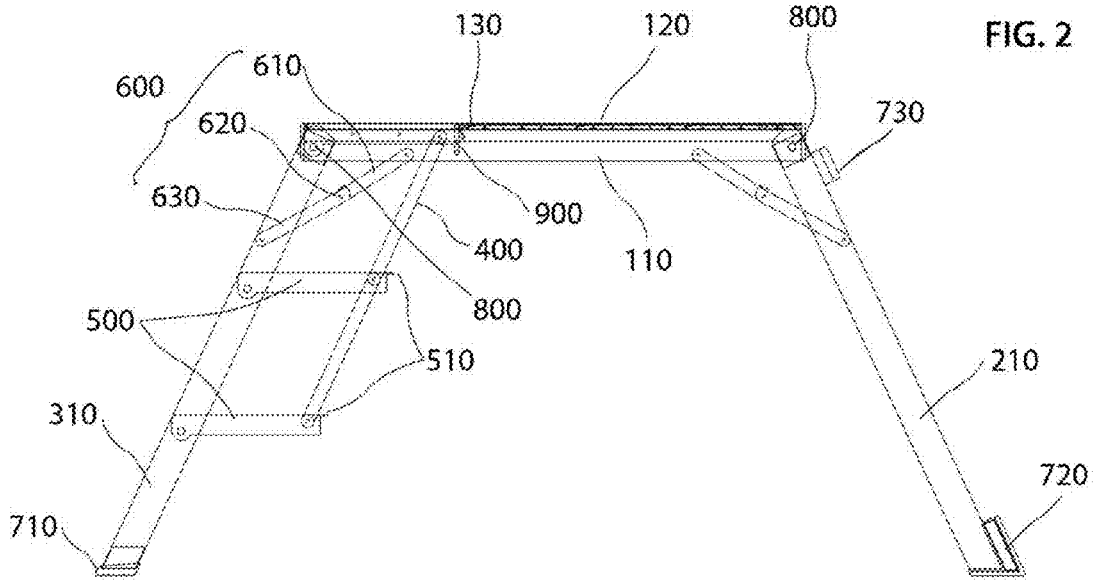
FIG. 2 is a front elevation view of the assembly in the work platform position.

FIGS. 1 and 2 show a combined stepladder and work platform assembly of the present invention in its work platform position. The assembly has a top frame (100) having a footplate (120), that is fixed between the side rails (110), covering only the rear part of the top frame (100), a back frame (200) pivotally attached to the backside of the top frame (100) by a hinge axis bar (800) and having two side rails (210), each of which having an upper end and pivotally attached to the side rail (110) of the top frame (100) at the back end, a front frame (300) pivotally attached to the front side of the top frame (100) by a hinge axis bar (800) and having two side rails (310), each of which having an upper end and pivotally attached to the side rail (110) of the top frame (100) at the front end, a plurality of steps (500), each end of which is pivotally attached to the side rails (310) of the front frame (300) and a pair of link bars (400) at the same intervals so that the steps (500) are substantially horizontal, a pair of braces (600), each of which having an upper end pivotally attached to the side rail (110) of the top frame (100) and a lower end pivotally attached to the side rail (210) of back frame (200) so that it secures the back frame (200) with the top frame (100) at a certain angle and another pair of braces (600), each of which having an upper end pivotally attached to the side rail (110) of the top frame (100) and a lower end pivotally attached to the side rail (310) of the front frame (300) so that it secures the front frame (300) with the top frame (100) at a certain angle.

The assembly includes an elastic foot (710) attached at the lower end of each of the side rails (310) of the front frame (300), an L shape elastic foot (720) attached at the lower end of each of the side rails (210) of the back frame (200) and another pair of elastic feet (730) attached at the backside of upper portion of the side rails (210) of the back frame (200).

The brace (600) above mentioned further includes a shorter arm (610) and a longer arm (630) pivotally connected by a pin (620) to allow pivoting of front frame (300) and back frame (200).

As described above, the assembly of the present invention in its work platform position includes a back frame (200), the upper end of which is pivotally attached to the back end of the top frame (100) by a hinge axis bar (800) and a front frame (300), the upper end of which is pivotally attached to the front end of the top frame (100) by a hinge axis bar (800). In its work platform position, the bottom surfaces of the L shape elastic feet (720) attached at the lower ends of side rails (210) of the back frame (200) make contact with floor and at the same time the elastic feet (710) attached at the lower ends of side rails (310) of the front frame (300) make contact with floor. However, the upper elastic feet (730) attached at the backside of upper portion of the side rails (210) of the back frame (200) remain attached at the upper portion of the side rails (210).

One ends of a plurality of steps (500) are pivotally attached to the side rails (310) of the front frame (300) at regular intervals, and the other ends of the steps (500) are pivotally attached to the link bars (400) at the same intervals.

The overhung end portion (510) of the uppermost step (500) is supported by the recessed end portion (130) of the foot plate (120) which blocks downward rotation of the steps (500) to maintain the steps (500) horizontal. As a result, the upper surface of the footplate (120) and the uppermost step (500) cover the top frame (100) jointly to form the top surface of the work platform.

The upper ends of two pair of braces (600) are pivotally attached to the side rails (110) of the top frame (100) and the lower ends of each pair of braces (600) are pivotally attached to the side rails (210, 310) of back frame (200) and front frame (300).

Figure 5:
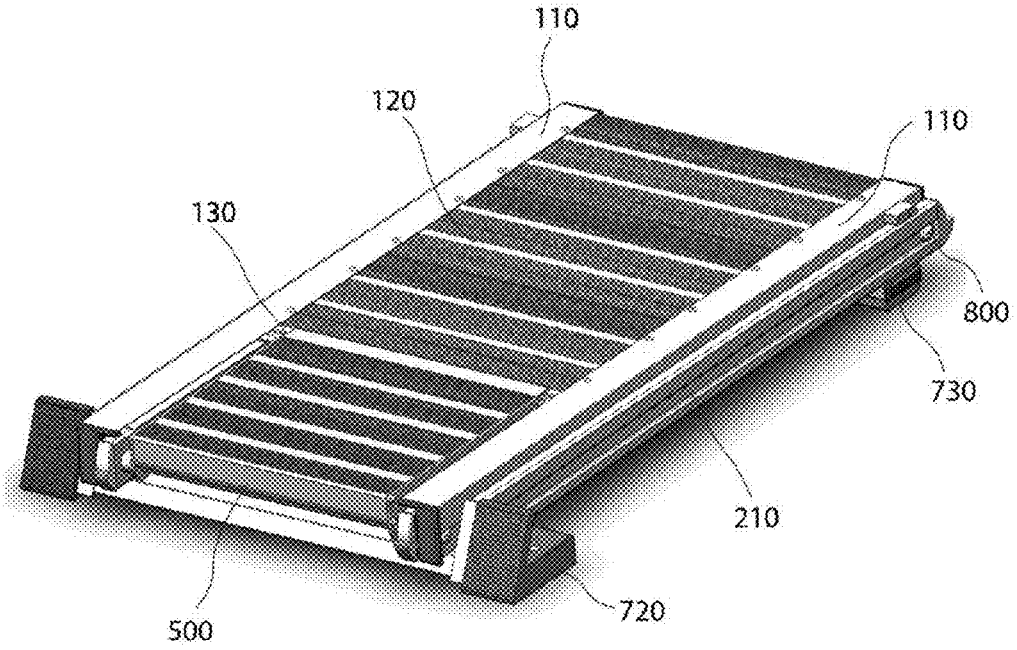
FIG. 5 is a perspective view of the assembly in the folded position.
Figure 6:
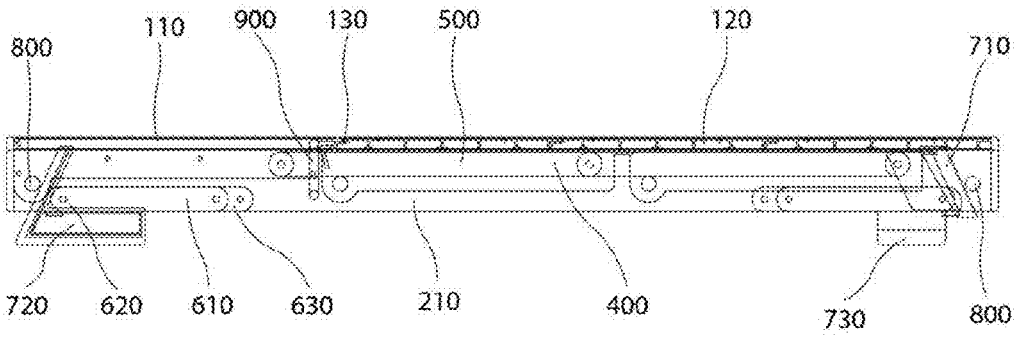
FIG. 6 is a front elevation view of the assembly in the folded position.

In case that the assembly of the present invention is desired to be used as work platform for the work such as painting or papering wall, from the folded position shown in FIGS. 5 and 6, the back frame (200) is rotated outward on the hinge axis bar (800) until the braces (600) are fully unfolded so that the back frame (200) makes a certain angle with the top frame (100). Then, the front frame (300) is rotated outward until the braces (600) are fully unfolded so that front frame (300) makes a certain angle with the top frame (100), and the link bars (400) are unfolded so that the steps (500) are substantially horizontal.

At this time, the overhung end portion (510) of the uppermost step (500) rests on the recessed end portion (130) of the foot plate (120) so that the steps (500) maintain substantially horizontal.

Figure 3:
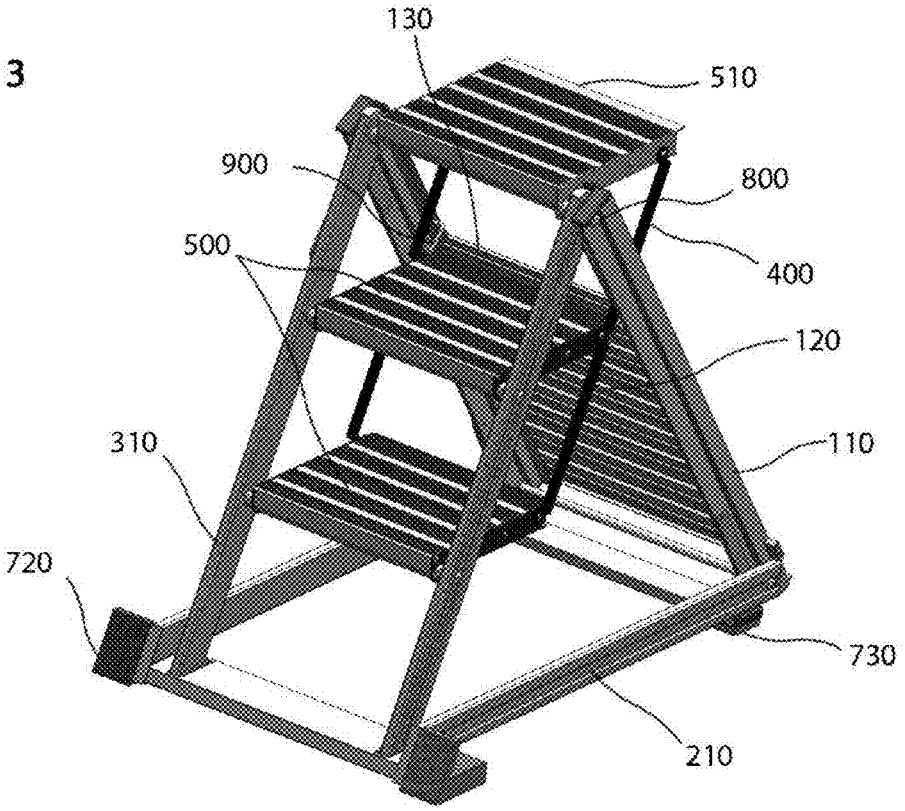
FIG. 3 is a perspective view of the assembly in the stepladder position.
Figure 4:
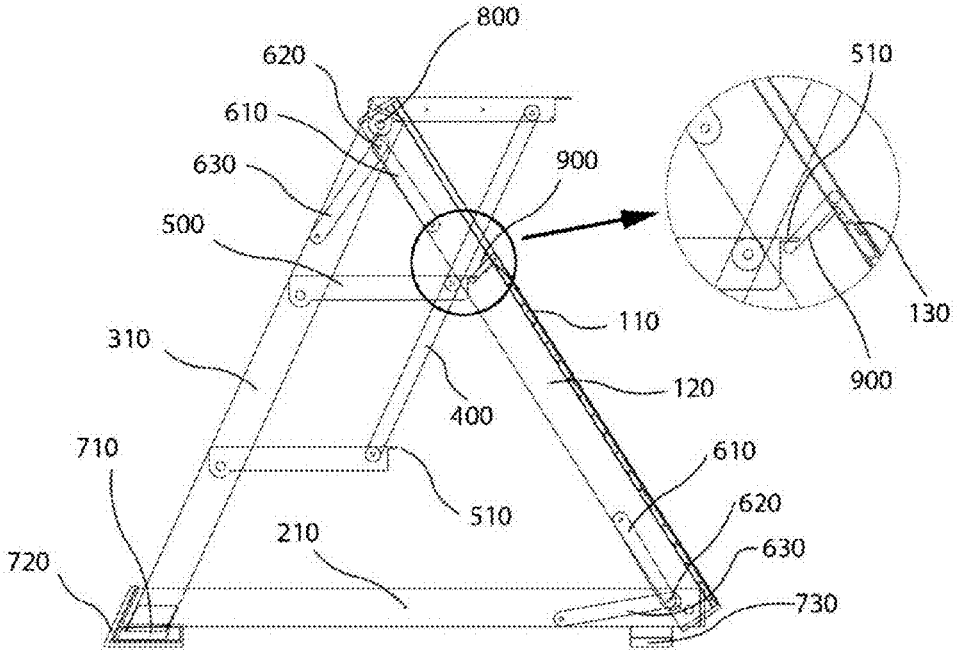
FIG. 4 is a front elevation view of the assembly in the stepladder position

FIGS. 3 and 4 show a combined stepladder and work platform assembly of the present invention in its stepladder position.

In case that the assembly is used as stepladder for a simple work such as replacing a light bulb, this stepladder position can be made easily from the folded position shown in FIGS. 5 and 6, or the work platform position shown in FIGS. 1 and 2.

If the stepladder position is made from the work platform position, the back frame (200) is rotated inward on the hinge axis bar (800) until the back frame (200) is parallel to the floor so that the upper elastic feet (730) and L shape elastic feet (720) make contact with floor.

Accordingly, the top frame (100) which is attached to the back frame (200), is also rotated on the hinge axis bar (800) so that the top frame (100) makes the acute angle with the front frame (300).

By connecting the lower end of the front frame (300) to the lower end of the back frame (200) as shown in FIG. 3, the front frame (300), the top frame (100) and the back frame (200) make a triangular shape.

When the triangular shape is made, the steps (500) are lifted up until the overhung end portion (130) of the second step (500) from the top rests on the support bar (900) which is pivotally attached to the inside of side rails (110) of the top frame (100) so that the steps (500) are maintained substantially horizontal.

In this stepladder position, the back frame (200) maintains a certain distance from the floor by the same thickness of the L shape elastic feet (720) and the upper elastic feet (730).

Although the invention has been described in considerable detail, other versions are possible by converting the aforementioned construction. Therefore, the scope of the invention shall not be limited by the specification specified above and the appended claims.

What is claimed is:

1. A combined stepladder and work platform assembly comprising:

(a) a top frame having two top side rails and a footplate fixed between the top side rails;

(b) a back frame pivotally attached to a back side of the top frame by a first hinge axis bar, the back frame having two back side rails, wherein each upper end of each of the two back side rails is pivotally attached to the corresponding top side rail at a back end of the top frame at a back end;

(c) a front frame pivotally attached to a front side of the top frame by a second hinge axis bar, the front frame having two front side rails, wherein each upper end of each of the two front side rails is pivotally attached to the corresponding top side rail at a front end of the top frame at a front end;

(d) two link bars;

(e) a plurality of steps, said plurality of steps having outer ends and inner ends, said outer ends are pivotally attached to the two front side rails of the front frame and said inner ends are pivotally attached to the link bars;

(f) two braces, each of which has an upper end pivotally attached to the corresponding top side rail of the top frame and a lower end pivotally attached to the corresponding side rail of the back frame;

(g) two braces, each of which has an upper end pivotally attached to the corresponding top side rail of the top frame and a lower end pivotally attached to the corresponding side rail of the front frame; and (h) an elastic foot attached at a lower end of each of the side rails of the front frame and an L-shaped elastic foot attached at a lower end of each of the back frame and another pair of elastic feet attached at an upper portion of the side rails of the back frame, wherein the back frame is configured to rotate outward on the first hinge axis bar until the braces are fully unfolded so that the back frame makes a certain angle with the top frame, wherein the back frame is configured to rotate inward on the first hinge axis bar until the back frame is parallel to the floor so that the elastic feet at the upper portion of the side rails of the back frame and the L-shape elastic feet make contact with ground floor, wherein the top frame is configured to rotate on the second hinge axis bar so that the top frame makes an acute angle with the front frame, and wherein an overhung end portion of an uppermost step is supported by a recessed end portion of the foot plate in a work platform position.

2. A combined stepladder and work platform assembly comprising:

(a) a top frame having two top side rails and a footplate fixed between the top side rails;

(b) a back frame pivotally attached to a back side of the top frame by a first hinge axis bar, the back frame having two back side rails, wherein each upper end of each of the two back side rails is pivotally attached to the corresponding top side rail at a back end of the top frame at a back end;

(c) a front frame pivotally attached to a front side of the top frame by a second hinge axis bar, the front frame having two front side rails, wherein each upper end of each of the two front side rails is pivotally attached to the corresponding top side rail at a front end of the top frame at a front end;

(d) two link bars;

(e) a plurality of steps, said plurality of steps having outer ends and inner ends, said outer ends are pivotally attached to the two front side rails of the front frame and said inner ends are pivotally attached to the link bars;

(f) two braces, each of which has an upper end pivotally attached to the corresponding top side rail of the top frame and a lower end pivotally attached to the corresponding side rail of the back frame;

(g) two braces, each of which has an upper end pivotally attached to the corresponding top side rail of the top frame and a lower end pivotally attached to the corresponding side rail of the front frame; and (h) an elastic foot attached at a lower end of each of the side rails of the front frame and an L-shaped elastic foot attached at a lower end of each of the back frame and another pair of elastic feet attached at an upper portion of the side rails of the back frame, wherein the back frame is configured to rotate outward on the first hinge axis bar until the braces are fully unfolded so that the back frame makes a certain angle with the top frame, wherein the back frame is configured to rotate inward on the first hinge axis bar until the back frame is parallel to the floor so that the elastic feet at the upper portion of the side rails of the back frame and the L-shape elastic feet make contact with ground floor, wherein the top frame is configured to rotate on the second hinge axis bar so that the top frame makes an acute angle with the front frame, and wherein an overhung end portion of a second step rests on a support bar which is pivotally attached to an inside of the rails of the top frame in a stepladder position.

3. The combined stepladder and work platform assembly of claim 1 wherein the pair of elastic feet attached at the upper portion of the side rails of the back frame and the L-shaped elastic feet attached at the lower end of the side rails of the back frame are configured to make contact with the ground floor in a stepladder position.

* * * * *